US009228734B2

(12) United States Patent
Chen

(10) Patent No.: US 9,228,734 B2
(45) Date of Patent: Jan. 5, 2016

(54) LIGHT-EMITTING DEVICE

(71) Applicant: Lextar Electronics Corporation, Hsinchu (TW)

(72) Inventor: Kuo-Chiang Chen, Hsinchu County (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 133 days.

(21) Appl. No.: 14/140,596

(22) Filed: Dec. 26, 2013

(65) Prior Publication Data

US 2015/0049495 A1 Feb. 19, 2015

(30) Foreign Application Priority Data

Aug. 13, 2013 (TW) ..... 102128998 A

(51) Int. Cl.

| | |
|---|---|
| ***F21V 29/00*** | (2015.01) |
| ***F21V 29/507*** | (2015.01) |
| ***F21K 99/00*** | (2010.01) |
| ***F21V 29/89*** | (2015.01) |

(52) U.S. Cl.

CPC ..... *F21V 29/507* (2015.01); *F21K 9/135* (2013.01); *F21K 9/1355* (2013.01); *F21V 29/89* (2015.01)

(58) Field of Classification Search

CPC ..... F21V 29/00; F21V 1/00; H05K 13/00
USPC ..... 362/294, 373, 249.02, 311.02
See application file for complete search history.

(56) References Cited

U.S. PATENT DOCUMENTS

| | | | | |
|---|---|---|---|---|
| 7,631,987 | B2 * | 12/2009 | Wei | 362/294 |
| 7,918,587 | B2 * | 4/2011 | Hsu et al. | 362/294 |
| 8,167,460 | B2 * | 5/2012 | Chu | 362/294 |
| 8,246,215 | B2 * | 8/2012 | Lu et al. | 362/294 |
| 2009/0135613 | A1 * | 5/2009 | Peng | 362/373 |
| 2011/0299286 | A1 * | 12/2011 | Chang et al. | 362/294 |
| 2013/0148360 | A1 * | 6/2013 | Jeon et al. | 362/294 |
| 2013/0335978 | A1 * | 12/2013 | Huang | 362/311.02 |

FOREIGN PATENT DOCUMENTS

| | | |
|---|---|---|
| TW | M442470 | 12/2012 |

* cited by examiner

*Primary Examiner* — Ali Alavi
(74) *Attorney, Agent, or Firm* — McClure, Qualey & Rodack, LLP

(57) ABSTRACT

A light-emitting device comprising a lamp casing, a heat dissipation element and a light-emitting module is provided. A first opening and a second opening are formed on an upper end and a lower end of the lamp casing respectively. An edge of the lamp casing adjacent to the first opening is bended inward to form a bending portion. The heat dissipation element has several carrying portions separated from each other and arranged in radial-shape, and several fins perpendicular to the carrying portions. Each fin is bended downward and vertically from an edge of the carrying portions and extended toward the second opening. The light-emitting module comprises a substrate and several light-emitting elements. An edge of the substrate leans against the bending portion, such that the light-emitting module is sandwiched between the carrying portions and the bending portion.

10 Claims, 3 Drawing Sheets

LIGHT-EMITTING DEVICE

This application claims the benefit of Taiwan application Serial No. 102128998, filed Aug. 13, 2013, the subject matter of which is incorporated herein by reference.

BACKGROUND OF THE INVENTION

1. Field of the Invention

The invention relates in general to a light-emitting device, and more particularly to a light-emitting device having several air holes.

2. Description of the Related Art

Accompany with the increase in the awareness of environmental protection, light-emitting diode (LED) lamps have attracted people's attention and been widely used. LED lamps have the advantages of high luminous efficiency, low power consumption and long lifespan, and are capable of emitting color lights. LEDs generate heat during a luminescence process. In order to dissipate the heat generated by the LEDs, the lamp casing of an LED lamp is normally formed by a heat conductive material for effectively convecting the heat to the exterior.

As the brightness of LED increasing, conventional lamp casing is no longer applicable. Therefore, how to design a lamp casing having better heat dissipation efficiency has become a prominent task for the industries.

SUMMARY OF THE INVENTION

The invention is directed to a light-emitting device, which effectively convections the heat generated inside the lamp casing to the exterior.

According to one embodiment of the present invention, a light-emitting device is provided. The light-emitting device comprises a lamp casing, a heat dissipation element and a light-emitting module. A first opening and a second opening are formed on an upper end and a lower end of the lamp casing. A received space is defined between the first opening and the second opening. An edge of the lamp casing adjacent to the first opening is bended inward to form a bending portion. The heat dissipation element is disposed within the received space, and has several carrying portions separated from each other and arranged in radial-shape, and several fins perpendicular to the carrying portions. Each fin is bended downward and vertically from an edge of the carrying portions and extended toward the second opening. The light-emitting module comprises a substrate and several light-emitting elements disposed on the substrate. The light-emitting module is disposed on the carrying portions of the heat dissipation element and an edge of the substrate leans against the bending portion, such that the light-emitting module is sandwiched between the carrying portions of the heat dissipation element and the bending portion of the lamp casing.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
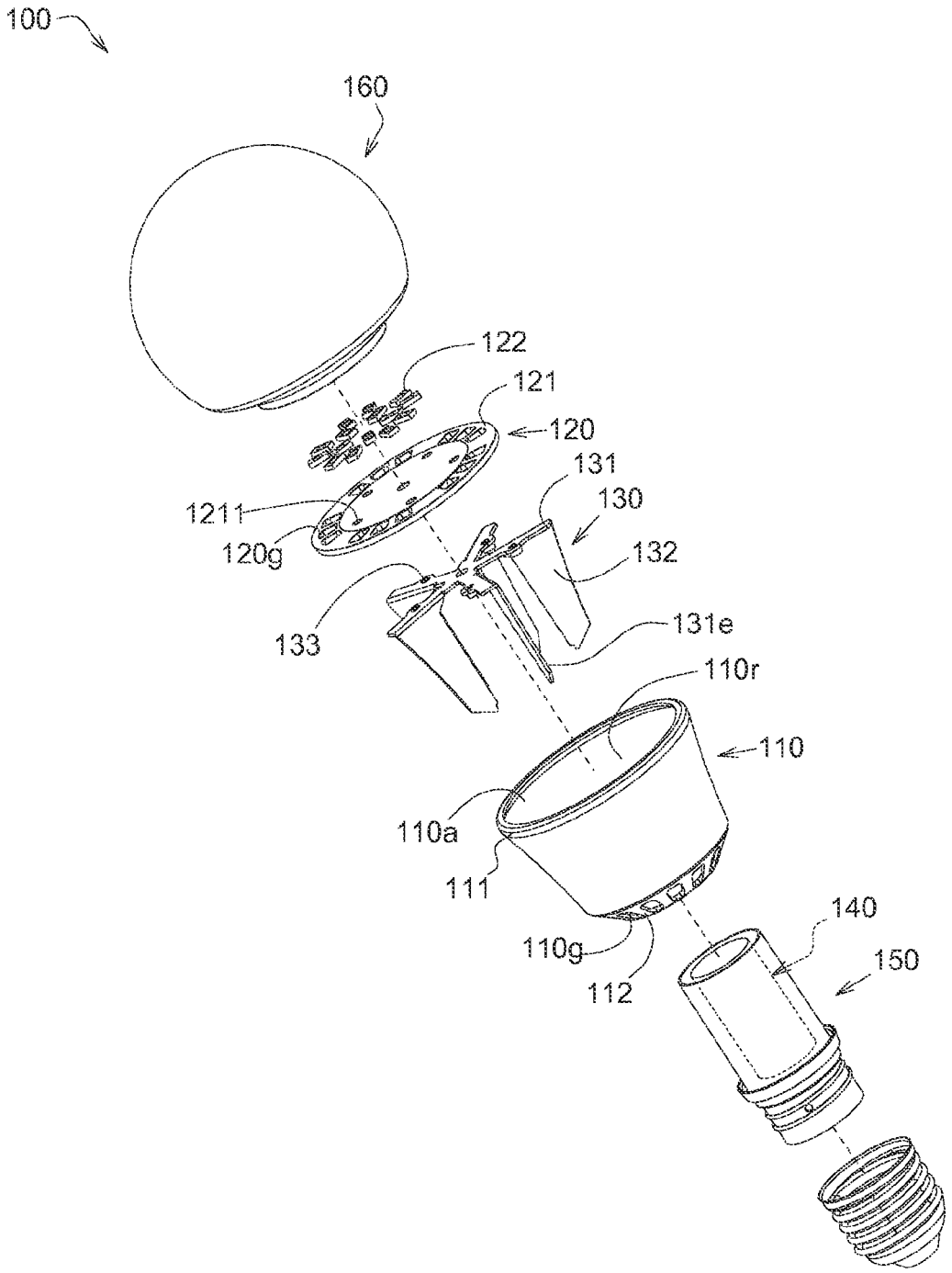
FIG. 1 is an explosion diagram of a light-emitting device according to an embodiment of the invention.

Referring to FIG. 1, an explosion diagram of a light-emitting device according to an embodiment of the invention is shown. The light-emitting device 100, such as a lamp, comprises a lamp casing 110, a light-emitting module 120, a heat dissipation element 130, a drive circuit 140, an insulation tube 150 and a lamp cover 160.

Figure 2:
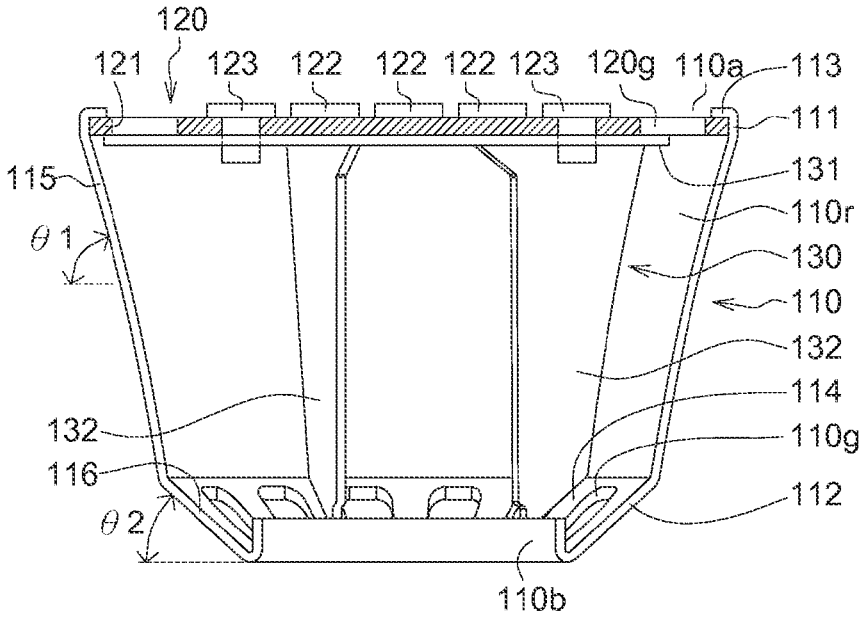
FIG. 2 is a cross-sectional view of the lamp casing, the heat dissipation element and the light-emitting module of FIG. 1 after assembly.

Referring to FIG. 2, a cross-sectional view of the lamp casing, the heat dissipation element and the light-emitting module of FIG. 1 after assembly is shown. The lamp casing 110 forms a received space 110*r*, and a first opening 110*a* and a second opening 110*b* are exposed from an upper end 111 and a lower end 112 of the lamp casing 110 respectively. The received space 110*r* is defined between the first opening 110*a* and the second opening 110*b*. An edge of the lamp casing 110 adjacent to the first opening 110*a* is bended inward to form a bending portion 113. The bending portion 113 leans against an edge of the light-emitting module 120 to fix the light-emitting module 120. An edge of the lamp casing 110 adjacent to the second opening 110*b* has several first air holes 110*g* surrounding the second opening 110*b*. The heat generated inside the lamp casing 110 can be convected to the exterior of the light-emitting device 100 through the first air holes 110*g*.

The lamp casing 110 can be integrally formed in one piece by a bending process or a pressing process. If the lamp casing 110 is integrally formed in one piece, the light-emitting module 120 can be disposed inside the lamp casing 110 and adjacent to the upper end 111 instead of being disposed adjacent to the first opening 110*a*. Then, an edge of the lamp casing 110 is bended inward to form the bending portion 113 by using the bending process. The bending portion 113 leans against an edge of the light-emitting module 120 to fix the light-emitting module 120. Here, the bending process is such as pressing or other suitable methods.

An inner diameter of the lamp casing 110 is getting shrinking from the upper end 111 towards the lower end 112 such that the lamp casing 110 is wide at the top and narrow at the bottom. When the light-emitting module 120 is disposed inside the lamp casing 110, the light-emitting module 120 will be restricted within the lamp casing 110 and adjacent to the upper end 111, hence restricting the height of the light-emitting module 120. In addition, the lamp casing 110 comprises a first portion 115 and a second portion 116. The first portion 115 has a tangent angle of $\theta 1$, and the second portion 116 is extended from the first portion 115 and has a tangent angle of $\theta 2$, wherein $\theta 1 > \theta 2$, such that the lamp casing 110 is wide at the top and narrow at the bottom. The said first opening 110*a* is disposed on the first portion 115, the second opening 110*b* is disposed on the second portion 116, and the first air holes 110*d* are disposed on the second portion 116.

The light-emitting module 120 comprises a substrate 121 and several light-emitting elements 122 disposed on the substrate 121. Although it is not illustrated in the diagram, the substrate 121 can be a metal printed circuit board (MCPCB), which has several layer, of circuits formed on the aluminum substrate. Or, the substrate 121 may comprises a metal substrate and a printed circuit board disposed on the metal substrate.

The light-emitting elements 122, such as LEDs or other light emitting sources, are disposed on the carrying portions 131 of the heat dissipation element 130 and the bending portion 113 leans against an edge of the substrate 121, such that the light-emitting module 120 is sandwiched between the carrying portions 131 of the heat dissipation element 130 and the bending portion 113 of the lamp casing 110. An edge of the substrate 121 of the light-emitting module 120 has several second air holes 120*g* surrounding the light-emitting elements 122. The heat generated inside the lamp casing 110 is quickly convected to the exterior of the light-emitting device 100 through the second air holes 120*g* and the said first air holes 110*g*.

The heat dissipation element 130 is disposed within the received space 110*r*. The heat dissipation element 130 has several carrying portions 131 separated from each other and arranged in radial-shape and several fins 132 perpendicular to the carrying portions 131. Each fin 132 is bended downward and vertically from an edge 131*e* of a corresponding carrying portion 131 (FIG. 1) and extended toward the second opening 110*b* until the fin leans against a bottom surface 114 of the received space 110*r*, so that the heat dissipation element 130 can be fixed. In another example, the fins 132 do not lean against a bottom surface 114 of the received space 110*r* but are fixed on the light-emitting module 120 through the heat dissipation element 130. The light-emitting module 120 is fixed within the lamp casing 110 by the bending portion 113, so that the heat dissipation element 130 is firmly fixed in the lamp casing 110 with the light-emitting module 120. In the manufacturing process of the heat dissipation element 130, the heat dissipation element 130 can be integrally formed by a stamping piece of sheet metal. Under such circumstance, the carrying portions 131 and the fins 132 are concurrently formed in the same manufacturing process. In another example, the heat dissipation element 130 and the fins 132 can be formed respectively, and then are integrated together by way of engagement, bonding, welding, screwing or other permanent or temporary methods.

Figure 3:
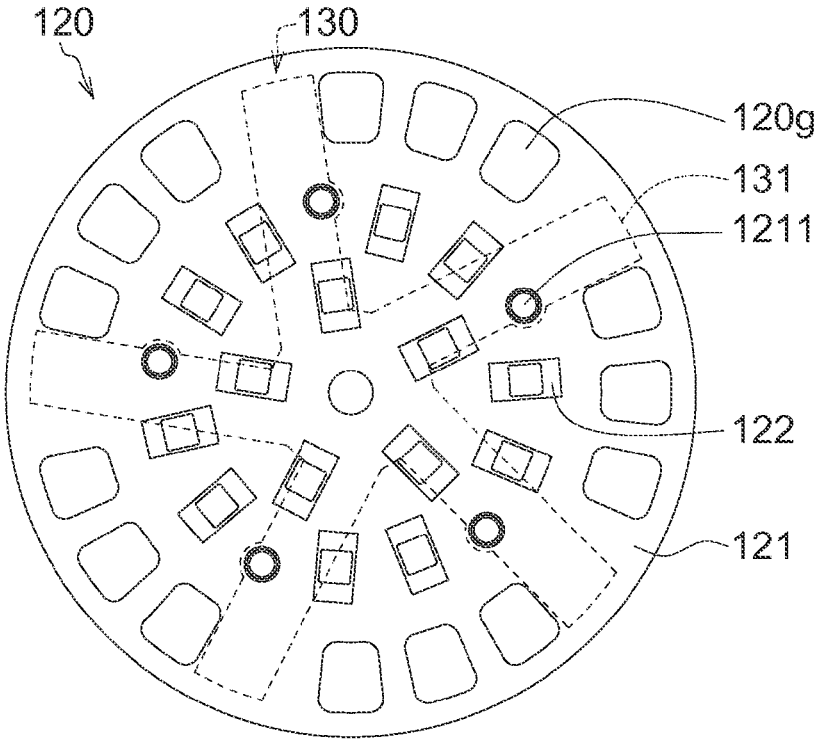
FIG. 3 is a top view of the substrate, the light-emitting elements and the heat dissipation element of FIG. 1 after assembly.

Referring to FIG. 3, a top view of the substrate, the light-emitting elements and the heat dissipation element of FIG. 1 after assembly is sown. The vertical projection of the carrying surface of the carrying portions 131 and the vertical projection of the second air holes 120*g* of the substrate 121 do not overlap with each other. Thus, when the heat generated inside the lamp casing 110 is not obstructed, the heat can be convected to the exterior of the light-emitting device 100 from the second air holes 120*g*.

Besides, the substrate 121 of the light-emitting module 120 further has several first screw holes 1211, and the heat dissipation element 130 further has several second screw holes 133 (FIG. 1). The light-emitting module 120 passes through the first screw holes 1211 and the second screw holes 133 by using several screws 123 (FIG. 2) so as to be screwed on the heat dissipation element 130. However, the embodiment of the invention is not limited thereto, and the light-emitting module 120 and the heat dissipation element 130 can be integrated together by way of engagement, bonding, welding or other permanent or temporary methods.

Figure 4:
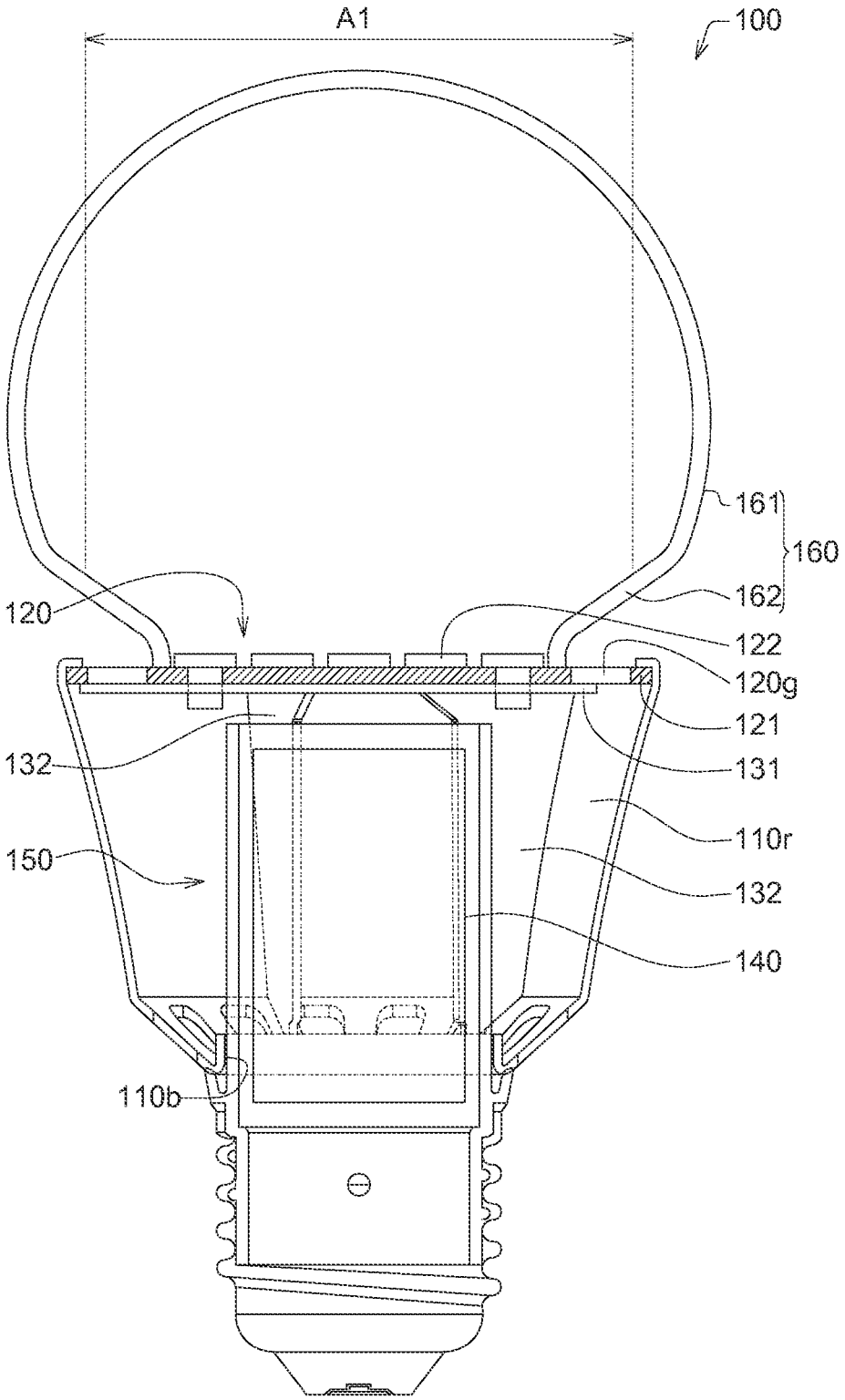
FIG. 4 is a cross-sectional view of the elements of FIG. 1 after assembly.

Referring to FIG. 4, a cross-sectional view of the elements of FIG. 1 after assembly. The drive circuit 140 is electrically connected to the light-emitting module 120 for controlling the light-emitting mode of the light-emitting elements 122. The drive circuit 140 is disposed within the received space 110*r* and under the carrying portions 131, and is electrically connected to the light-emitting module 120. The insulation tube 150 enters the received space 110*r* through the second opening 110*b*, and is fixed within the received space 110*r*. The insulation tube 150 is disposed under the substrate 121 and is surrounded by several fins 132 (FIG. 1 shows several fins 132 which are radially arranged). The drive circuit 140 is disposed inside the insulation tube 150, and will not electrically contact the heat dissipation element 130.

The lamp cover 160 covers the light-emitting elements 122 of the light-emitting module 120, such that the second air holes 120*g* are disposed outside the region covered by the lamp cover 160. Since the second air holes 120*g* are not covered by the lamp cover 160, the heat convected to the light-emitting device 100 through the second air holes 120*g* will not be blocked by the lamp cover 160, and the heat dissipation efficiency of the entire light-emitting device 100 can thus be improved. In terms of structure, the lamp cover 160 has a spherical portion 161 and a necking portion 162. An area A1 of the horizontal cross-section of the necking portion 162 is getting shrinking as the distance to the spherical portion 161 edge increases, such that the part of the necking portion 162 adjacent to the first opening 110*a* will not cover the second air holes 120*g*.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A light-emitting device, comprising:

a lamp casing, wherein a first opening and a second opening are formed on an upper end and a lower end of the lamp casing, a received space is formed between the first opening and the second opening, and an edge of the lamp casing adjacent to the first opening is bended inward to form a bending portion;

a heat dissipation element disposed within the received space, wherein the heat dissipation element has a plurality of carrying portions separated from each other and arranged in radial-shape and a plurality of fins perpendicular to the carrying portions, and each fin is bended downward and vertically from an edge of the corresponding carrying portion and extended toward the second opening;

a light-emitting module comprising a substrate and a plurality of light-emitting elements disposed on the substrate, wherein the light-emitting module is disposed on the carrying portions of the heat dissipation element and an edge of the substrate leans against the bending portion, such that the light-emitting module is sandwiched between the carrying portions of the heat dissipation element and the bending portion of the lamp casing;

wherein an edge of the substrate of the light-emitting module has a plurality of second air holes, and the vertical prosection of the second air holes and the vertical projection of the carrying surfaces do not overlap with each other.

2. The light-emitting device according to claim 1, wherein the lamp casing has a plurality of first air holes adjacent to the second opening and surrounding the second opening.

3. The light-emitting device according to claim 2, wherein the second air holes surround the light-emitting elements.

4. A light-emitting device according to claim 3, further comprising:

a lamp cover covering the light-emitting elements of the light-emitting module such that the second air holes are located outside the region covered by the lamp cover.

5. The light-emitting device according to claim 4, wherein the lamp cover has a spherical portion and a necking portion, and an area of the horizontal cross-section of the necking portion is getting shrinking as the distance to the spherical portion edge increases.

6. The light-emitting device according to claim 4, wherein the lamp casing comprises a first portion having a tangent angle θ1 and a second portion extended from the first portion and having a tangent angle θ2, the tangent angle θ1 is larger than the tangent angle θ2, the first opening is disposed on the first portion, the second opening is disposed on the second portion, and the first air holes are disposed on the second portion.

7. The light-emitting device according to claim 1, wherein the heat dissipation element is integrated into one piece or is a pressing piece of sheet metal.

8. The light-emitting device according to claim 7, wherein the substrate of the light-emitting module further has a plurality of first screw holes, the heat dissipation element further has a plurality of second screw holes, and the light-emitting module is screwed on the heat dissipation element by a plurality of screws passing through the first screw holes and the second screw holes.

9. The light-emitting device according to claim 8, further comprising a drive circuit disposed within the received space and under the carrying portions, and electrically connected to the light-emitting module.

10. The light-emitting device according to claim 9, further comprising an insulation tube fixed within the received space, under the substrate and surrounded by the fins, and the drive circuit is disposed inside the insulation tube.

* * * * *